US007228669B1

(12) United States Patent
Yaraschefski

(10) Patent No.: US 7,228,669 B1
(45) Date of Patent: Jun. 12, 2007

(54) SUSPENDED TABLE ASSEMBLY

(76) Inventor: Steven M. Yaraschefski, P.O. Box 694, 4660 N. 500 West, Bargersville, IN (US) 46106

( * ) Notice: Subject to any disclaimer, the term of this patent is extended or adjusted under 35 U.S.C. 154(b) by 30 days.

(21) Appl. No.: 11/150,770

(22) Filed: Jun. 13, 2005

(51) Int. Cl.
*E04B 2/00* (2006.01)
*E04B 5/00* (2006.01)
*E04B 9/00* (2006.01)

(52) U.S. Cl. ..... 52/506.06; 248/148; 248/317; 248/323; 248/327; 248/333; 248/340; 248/320; 248/235; 248/341; 248/200.1; 312/245; 108/149; 108/147.19; 108/144.11; 182/150; 182/28; 182/141; 182/142; 182/144; 52/506.07; 52/39

(58) Field of Classification Search ..... 248/148, 248/317, 323, 327, 333, 340, 320, 235, 341, 248/200.1; 312/245; 108/149, 147.19, 144.11; 182/150, 28, 141, 142, 144, 182; 52/506.06, 52/39, 506.07
See application file for complete search history.

(56) References Cited

U.S. PATENT DOCUMENTS 862,372 A * 8/1907 Alexander ..... 403/241
1,152,582 A * 9/1915 Werner ..... 235/3
1,189,044 A * 6/1916 Boden ..... 248/333
1,213,638 A * 1/1917 Henderson et al. ..... 43/109
1,260,123 A * 3/1918 Areson ..... 248/327
1,444,542 A * 2/1923 Grossheim ..... 248/317
1,586,053 A * 5/1926 Snyder ..... 52/737.6
1,794,381 A * 3/1931 Hosbein ..... 248/228.1
2,452,120 A * 10/1948 Gorne ..... 248/341
2,452,778 A * 11/1948 Mathewson ..... 403/127
2,484,173 A * 10/1949 Leas ..... 248/341
2,650,056 A * 8/1953 Masoner ..... 248/323
2,762,598 A * 9/1956 Runge ..... 248/327
2,830,707 A * 4/1958 Schmidt et al. ..... 211/113
2,933,279 A * 4/1960 Thomas ..... 248/317
2,947,585 A * 8/1960 Fazio ..... 108/44
3,005,653 A * 10/1961 Becker ..... 294/74
3,123,120 A 3/1964 Grimm et al.
3,168,252 A * 2/1965 Cabernoch ..... 362/404
3,512,743 A * 5/1970 Lipscomb ..... 248/324
3,537,499 A 11/1970 Dey et al.
3,592,146 A * 7/1971 Loomans ..... 108/149
3,695,324 A 10/1972 Gulistan
3,721,484 A * 3/1973 Macioge et al. ..... 312/245
3,735,951 A * 5/1973 Reed ..... 248/340
3,743,287 A * 7/1973 Liermann ..... 473/12
4,014,540 A * 3/1977 Caulkins ..... 472/14
4,630,423 A * 12/1986 Lind ..... 52/506.06
4,947,607 A * 8/1990 Stein ..... 52/506.06
D313,588 S * 1/1991 Gecchelin ..... D13/154
5,152,582 A 10/1992 Magnuson
5,772,169 A * 6/1998 Blockley ..... 248/333
5,851,107 A * 12/1998 Wang ..... 416/244 R
5,873,556 A * 2/1999 Reiker ..... 248/323

(Continued)

*Primary Examiner*—Carl D. Friedman
*Assistant Examiner*—Nkeisha Dumas

(57) ABSTRACT

A suspended table assembly includes a first support and a second support that are vertically spaced from each other. A plurality of legs is provided. Each of the legs has a first end and a second end. Each of a plurality of first brackets is pivotally coupled to one of the first ends. The first brackets are attached to the first support. A plurality of second brackets is also provided. Each of the second brackets is pivotally coupled to one of the second ends and each of the second brackets is attached to the second support.

9 Claims, 6 Drawing Sheets

U.S. PATENT DOCUMENTS 5,946,875 A * 9/1999 Jeanseau ..... 52/506.08
6,042,072 A * 3/2000 Chi-Nan ..... 248/343
6,045,288 A * 4/2000 Pasternak et al. ..... 403/109.3
D423,832 S * 5/2000 Kane et al. ..... D6/499
6,070,383 A * 6/2000 Jeanseau ..... 52/506.05
6,105,510 A * 8/2000 Skoff et al. ..... 108/44
6,145,678 A * 11/2000 Morrison ..... 211/113
6,183,180 B1 2/2001 Copple et al.
6,202,361 B1 * 3/2001 Thorp et al. ..... 52/39
6,280,145 B1 * 8/2001 Liu ..... 416/244 R
D450,572 S 11/2001 Nimmo et al.
6,575,100 B2 * 6/2003 Faucher et al. ..... 104/126
6,725,608 B1 * 4/2004 Kraus ..... 52/36.4
2002/0063102 A1 * 5/2002 Hanneken ..... 211/113
2004/0020138 A1 * 2/2004 Grearson ..... 52/64
2005/0133680 A1 * 6/2005 Heath ..... 248/317

* cited by examiner

SUSPENDED TABLE ASSEMBLY

BACKGROUND OF THE INVENTION

1. Field of the Invention

The present invention relates to table and bracket devices and more particularly pertains to a new device for suspending from an overhead support and which is adapted to retain its orientation with respect to gravity.

2. Description of the Prior Art

The use of bracket devices is known in the prior art. U.S. Pat. No. 5,132,582 describes a device for attaching a leg to an object and allowing the leg to be self-aligning. Another type of bracket device is U.S. Pat. No. 3,123,120 includes a floating anchor bolt for allowing selectively movement of an item secured with the device. Still yet another bracket device is found in U.S. Pat. No. 6,183,180.

While these devices fulfill their respective, particular objectives and requirements, the need remains for a device that allows a table to be suspended from an overhead support such as a ceiling, beams, or pipes extending across the ceiling. Additionally, the device should attach the table to the overhead support in such a manner that the table is self-aligning based on gravitational pull. This will allow the device to be used on items such as boats where waves will move the orientation of the table with respect to gravity. This makes map reading more difficult and can lead to seasickness. A self-stabilizing table, however, will allow easy reading and provide a constant reference point.

SUMMARY OF THE INVENTION

The present invention meets the needs presented above by generally comprising a first support and a second support that are vertically spaced from each other. A plurality of legs is provided. Each of the legs has a first end and a second end. Each of a plurality of first brackets is pivotally coupled to one of the first ends. The first brackets are attached to the first support. A plurality of second brackets is also provided. Each of the second brackets is pivotally coupled to one of the second ends and each of the second brackets is attached to the second support.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty that characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 3:
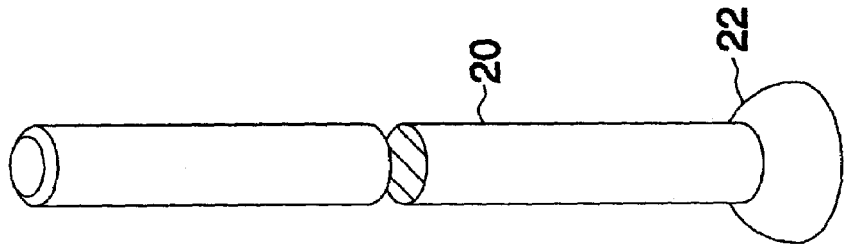
FIG. 3 is a perspective view of a leg of the present invention.
Figure 2:
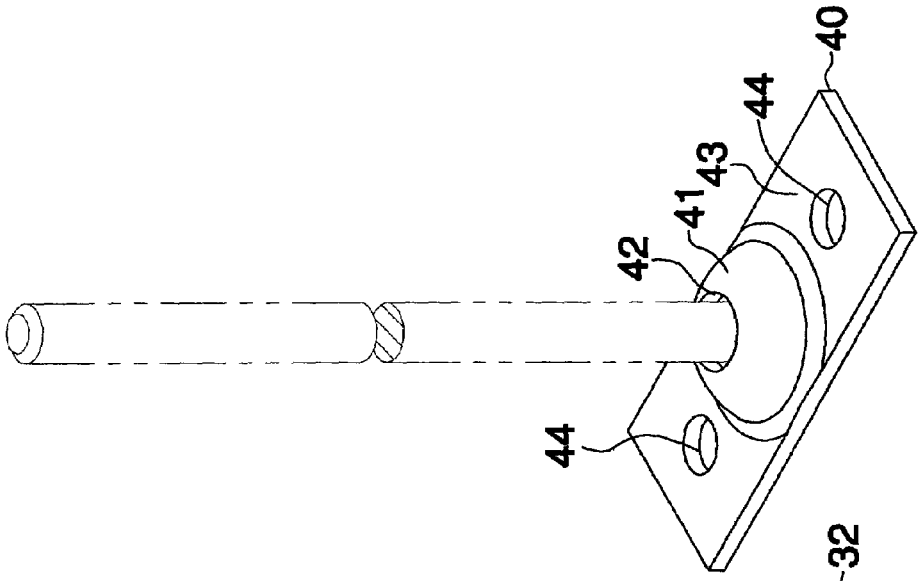
FIG. 2 is a perspective view of a second bracket of the present invention.
Figure 1:
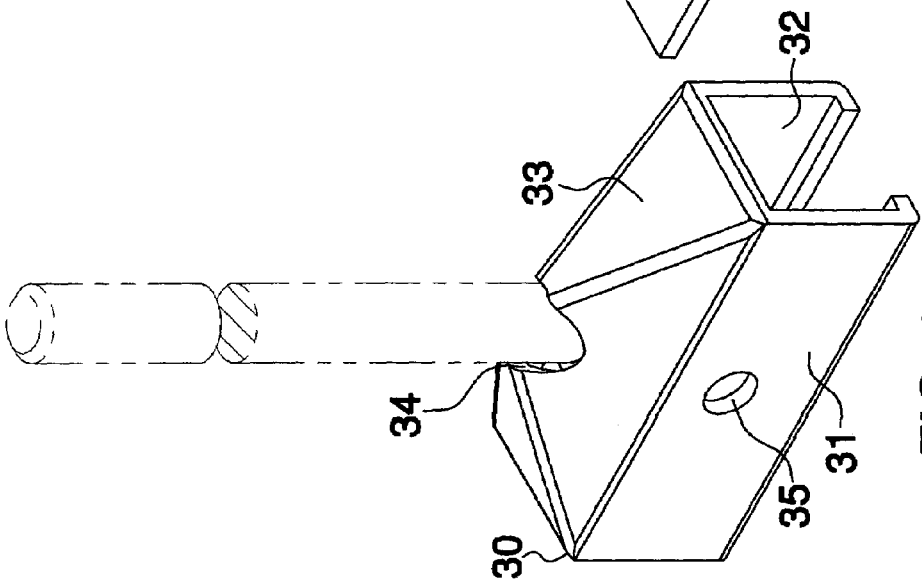
FIG. 1 is a perspective view of a first bracket of a suspended table assembly according to the present invention.

With reference now to the drawings, and in particular to FIGS. 1 through 8 thereof, a new table device embodying the principles and concepts of the present invention and generally designated by the reference numeral 10 will be described.

Figure 4:
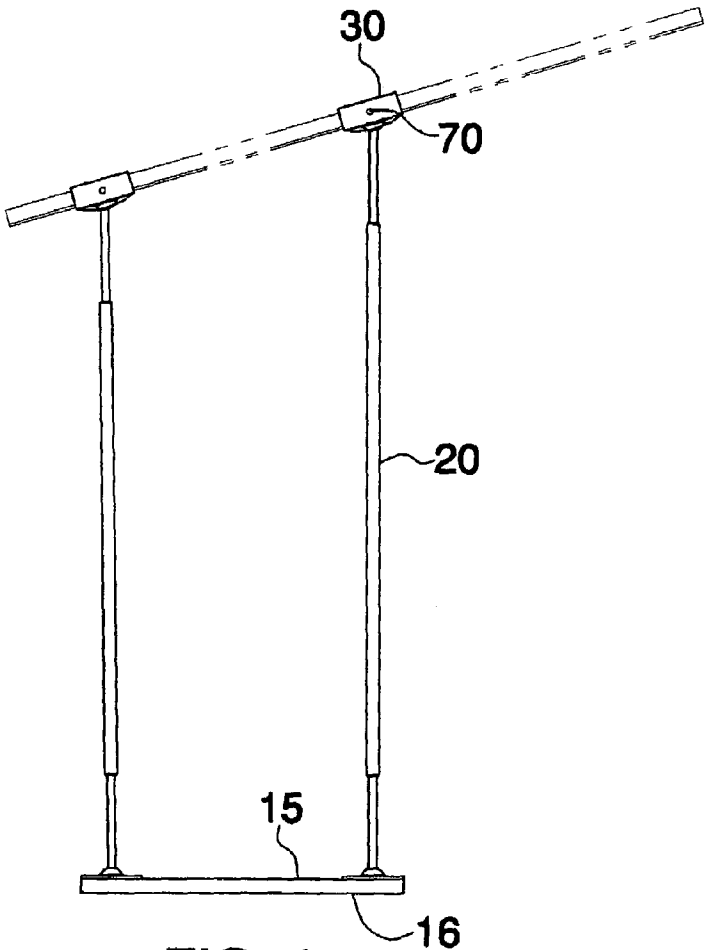
FIG. 4 is a side in-use view of the present invention.
Figure 5:
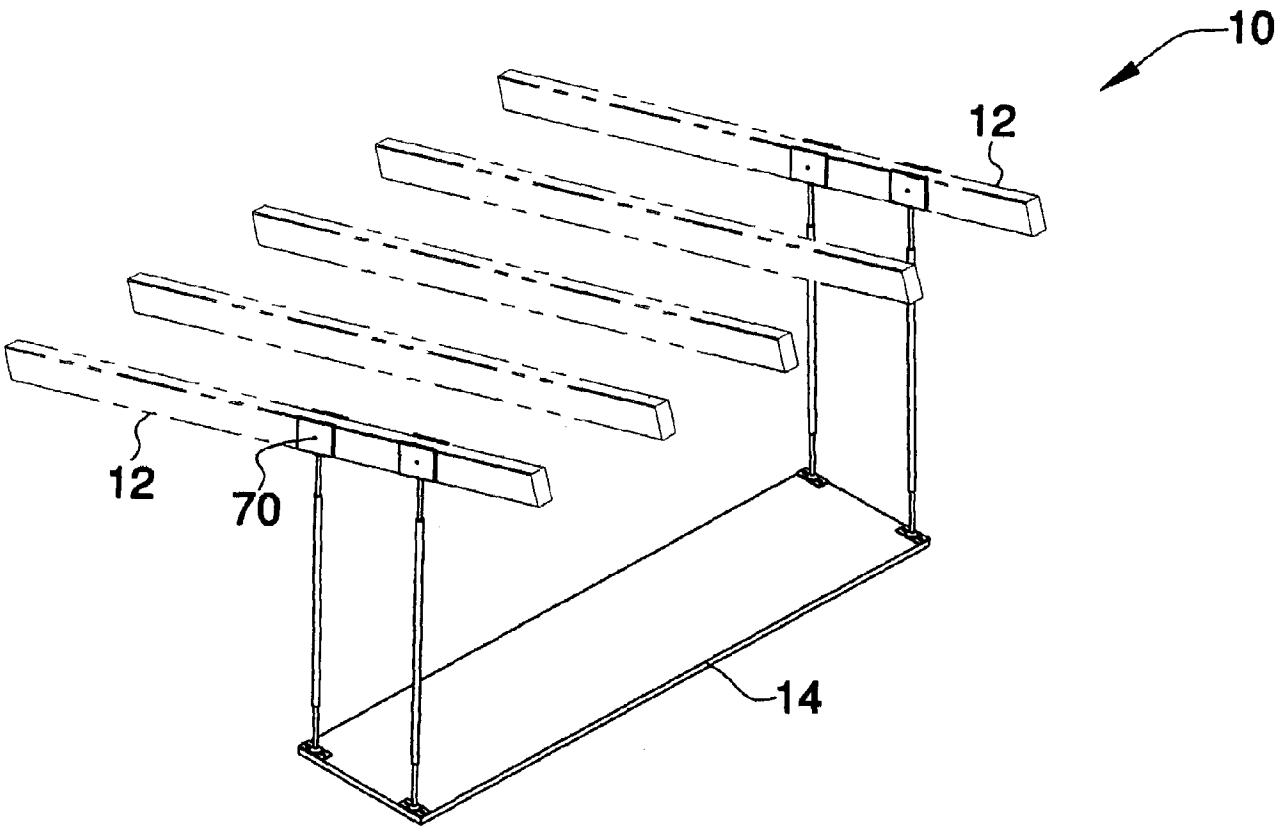
FIG. 5 is a perspective in-use view of the present invention.

As best illustrated in FIGS. 1 through 8, the suspended table assembly 10 generally comprises a first support 12 that is positioned above and spaced from a floor surface. The first support 12 comprises a plurality of elongated members such as overhead beams as shown in FIGS. 4 and 5. A second support 14 comprises a planar member that has a first side 15 and a second side 16 and is again shown in FIGS. 4 and 5.

A plurality of legs 20 is provided. Each of the legs 20 has a first end 21 and a second end 22 and each of the legs 20 is preferably telescoping. Each of the first 21 and second 22 ends has a hemispherical shape and has a planar side facing away from the legs 20.

A plurality of first brackets 30 is provided. Each of the first brackets 30 is pivotally coupled to one of the first ends 21. Each of the first brackets 30 is attached to the first support 12. The first brackets 30 each include a first plate 31 having an upper edge, a second plate 32 having an upper edge and a middle plate 33 that is attached to and extends between the upper edges of the first 31 and second 32 plates. The first 31 and second 32 plates are orientated parallel to each other. The middle plate 33 has a centrally located aperture 34 extending therethrough. Each of the legs 20 extends through one of the apertures 34 and the first ends 21 abut the middle plate 33. The middle plate 33 is angled upwardly from the upper edges to the aperture 34 or may have a convex shape arcing away from the first 31 and second 32 plates. Each of the first 31 and second 32 plates has an opening 35 extending therethrough and the openings 35 are aligned with each other. The elongated members 12 are positioned between the first 31 and second 32 plates. A plurality of fasteners 70 is provided. Each of the fasteners 70 extends through an aligned one of the openings 35 and releasably secures the elongated members 12 between the first 31 and second plates 32.

A plurality of second brackets 40 is also provided. Each of the second brackets 40 is pivotally coupled to one of the second ends 21. Each of the second brackets 40 is attached to the first side 15 of the second support 14 so that the second support 14 is suspended from the first support. The second brackets 40 each comprise a panel 43 having a central area 41 with a leg receiving hole 42 extending therethrough. Each of the legs 20 extends through one of the leg receiving holes 42 and the second ends 22 abut the panels 43. The central area 41 is convex and defines a convex portion. Each of the panels 43 has secondary holes 44 extending therethrough. The secondary holes 44 are positioned on either side of the convex portion. Each of a plurality of fasteners 70 extends through one of the secondary holes 44 and into the second support 14.

Figure 6:
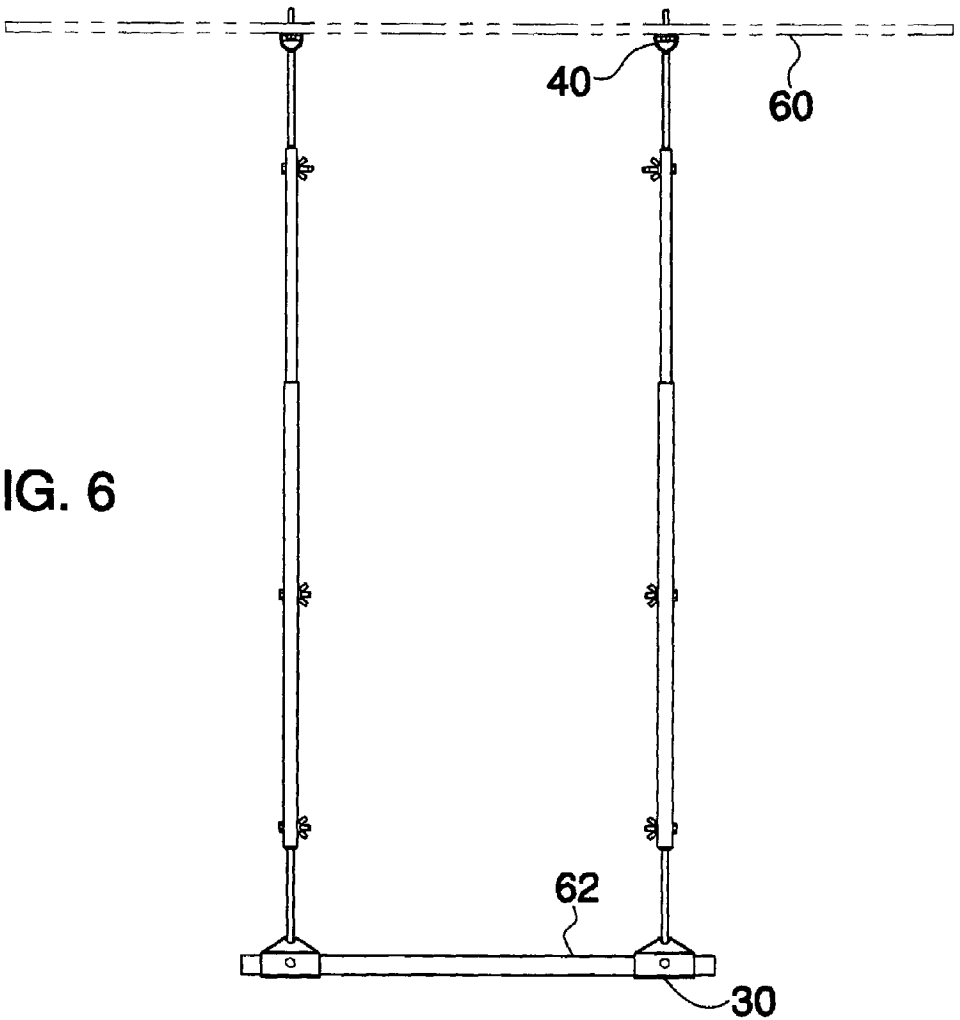
FIG. 6 is a side in-use view of a second usage of the present invention.
Figure 7:
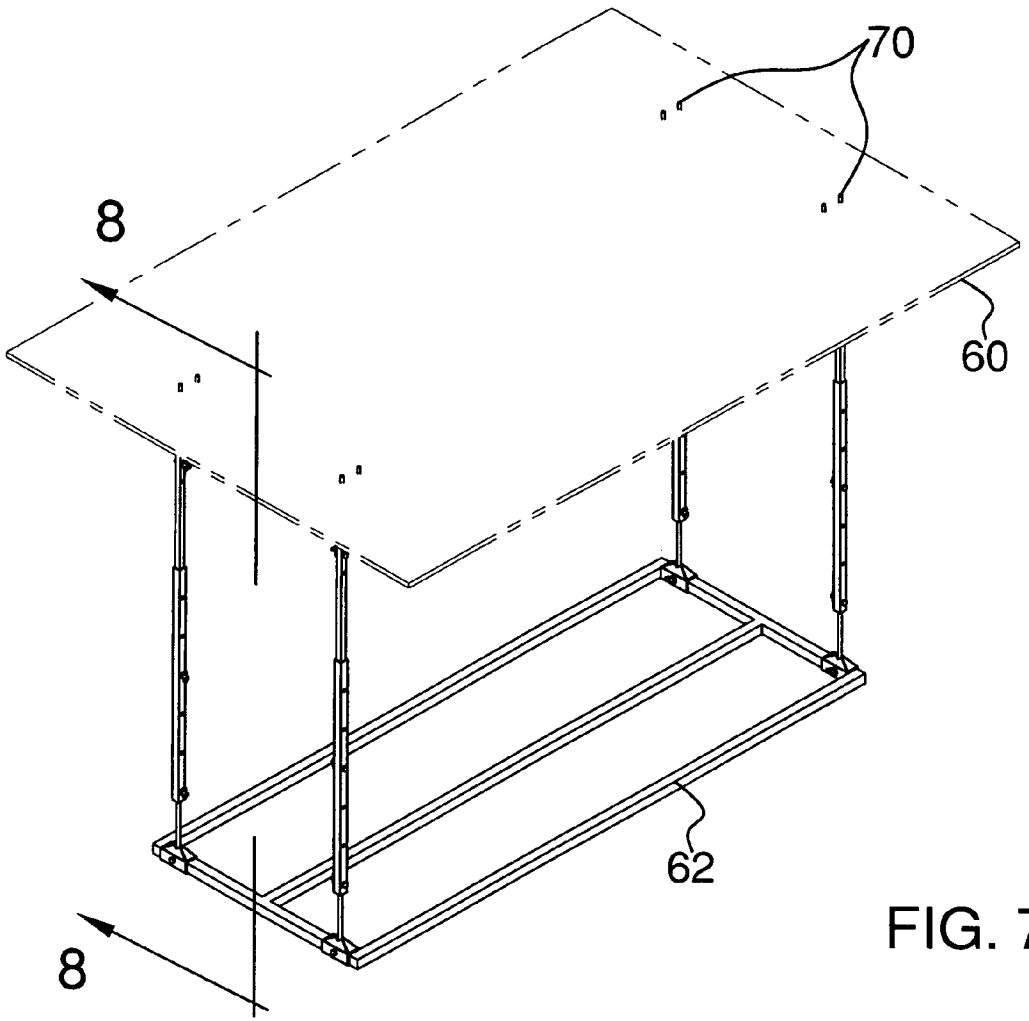
FIG. 7 is a perspective in-use view of the second usage of the present invention.
Figure 8:
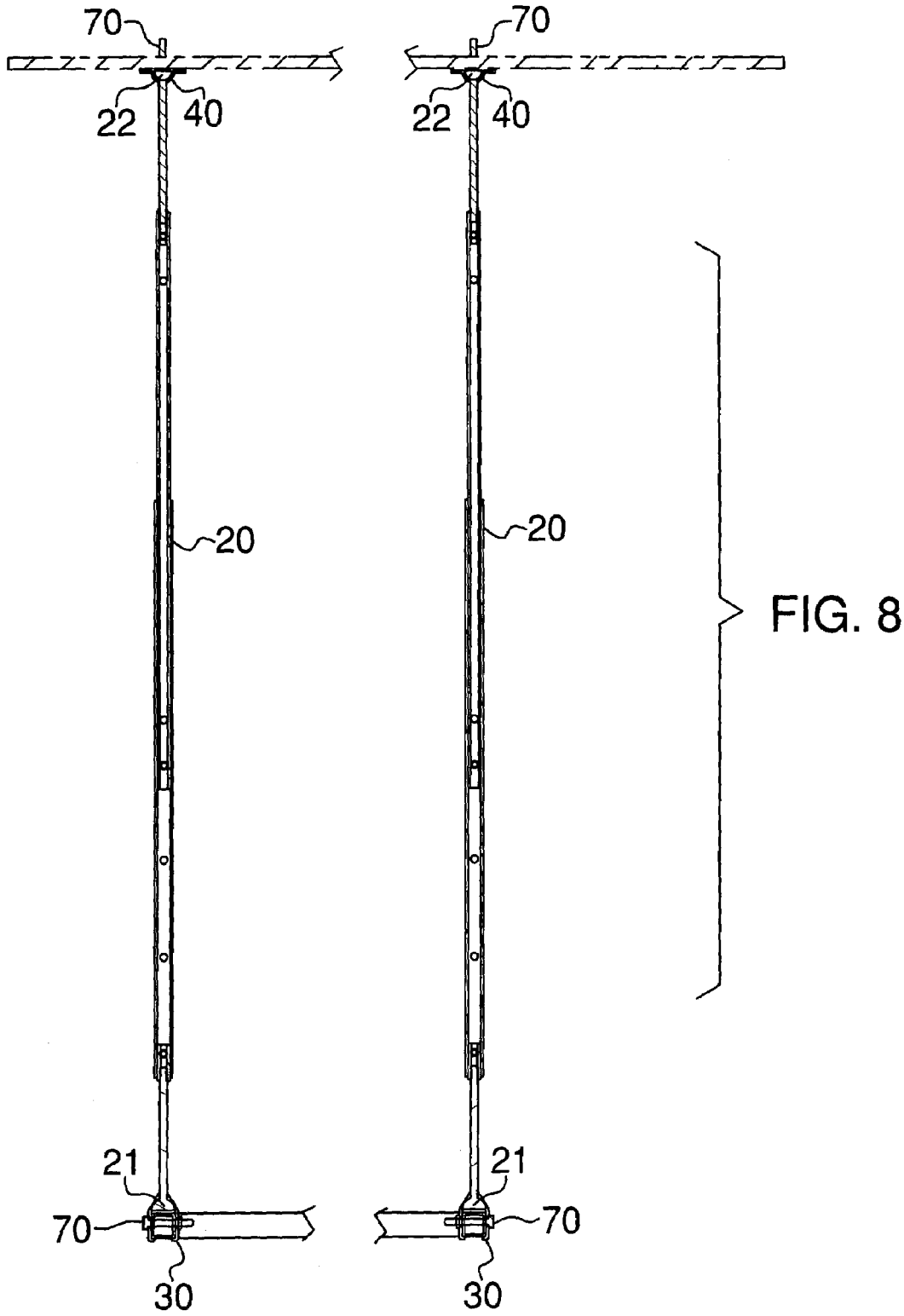
FIG. 8 is a cross-sectional view taken along line 8-8 of FIG. 7 of the present invention.

It should be understood that the first 30 and second 40 brackets might be used in a variety of ways separate from those discussed above. FIGS. 6-8 show the second brackets 40 being attached to a planar upper support 60 having a first side and a second side. The second brackets 40 are attached to the planar upper support 60 with the fasteners 70 so that the legs 20 extend downwardly from the planar upper support 60. The second brackets 40 may then also be used to attach the legs 20 to a planar member 14 as described above, or the first brackets 30 may attach the legs to a frame 62 of elongated members so that the frame 62 is suspended from the planar upper support 60. A table or objects may then be supported on or hung on the frame 62.

In use, the legs 20 may be mounted from the upper support 12 and attached to the lower support 14 in any of the ways mentioned above. The lower support 14 will then be in a suspended state and may be used as a table. The first 30 and second 40 brackets allow the legs 20 to pivot so that the table will remain in a selected orientation. While such a structure may be used in generally any type of dwelling, the table will have particular use on a boat or plane where waves and turbulence would otherwise move a conventional table out of a static orientation.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A suspended table system comprising:

a first support and a second support being vertically spaced from each other, said first support being positioned above and spaced from a floor surface, said second support being positioned below said first support and being suspended from said first support, said first support comprising a plurality of elongated members;

a plurality of legs, each of said legs having a first end and a second end, each of said first and second ends having a hemispherical shape and including an arcuate side and a planar side, said planar sides each facing away from an associated one of said legs to define a terminal end of said legs, each of said planar sides lying in a plane orientated approximately perpendicular to a longitudinal axis of said associated one of said legs;

a plurality of first brackets, each of said first brackets being pivotally coupled to one of said first ends, each of said first brackets being attached to said first support, each of said first brackets including;

a first plate having an upper edge;

a second plate having an upper edge;

a middle plate being attached to and extending between said upper edges of said first and second plates, said first and second plates being orientated parallel to each other, said middle plate having a centrally located aperture extending therethrough, each of said legs extending through one of said apertures and said first ends abutting said middle plate, each of said first and second plates having an opening extending therethrough and each of said openings is aligned with each other, said elongated members being positioned between said first and second plates, said middle plate being angled upwardly from said upper edges to said aperture;

a plurality of fasteners, each of said fasteners extending through an aligned one of said openings and releasably securing said elongated members between said first and second plates; and a plurality of second brackets, each of said second brackets being pivotally coupled to one of said second ends, each of said second brackets being attached to said second support.

2. The system according to claim 1, wherein said second support comprises a planar member having a first side and a second side.

3. The system according to claim 1, wherein each of said legs is selectively telescoping.

4. The system according to claim 1, wherein each of said second brackets comprising a panel, each of said panels having a central area having a leg receiving hole extending therethrough, each of said legs extending through one of said leg receiving holes and said second ends abutting said panels.

5. The system according to claim 4, wherein said central area is convex and defines a convex portion, each of said panels having secondary holes extending therethrough and being positioned on either side of said convex portion, each of a plurality of fasteners extending through one of said secondary holes and into said second support.

6. A suspended table system comprising:

a first support being positioned above and spaced from a floor surface, said first support comprising a plurality of elongated members;

a second support comprising a planar member having a first side and a second side;

a plurality of legs, each of said legs having a first end and a second end, each of said legs being selectively telescoping, each of said first and second ends having a hemispherical shape and including an arcuate side and a planar side, said planar sides each facing away from an associated one of said legs to define a terminal end of said legs, each of said planar sides lying in a plane orientated approximately perpendicular to a longitudinal axis of said associated one of said legs;

a plurality of first brackets, each of said first brackets being pivotally coupled to one of said first ends, each of said first brackets being attached to said first support, each of said first brackets including;

a first plate having an upper edge;

a second plate having an upper edge;

a middle plate being attached to and extending between said upper edges of said first and second plates, said first and second plates being orientated parallel to each other, said middle plate having a centrally located aperture extending therethrough, each of said legs extending through one of said apertures and said first ends abutting said middle plate, said middle plate being angled upwardly from said upper edges to said aperture, each of said first and second plates having an opening extending therethrough and each of said openings being aligned with each other, said elongated members being positioned between said first and second plates;

a plurality of fasteners, each of said fasteners extending through an aligned one of said openings and releasably securing said elongated members between said first and second plates; and a plurality of second brackets, each of said second brackets being pivotally coupled to one of said second ends, each of said second brackets being attached to said first side of said second support such that said second support is suspended from said first support, each of said second brackets comprising a panel, each of said panels having a central area having a leg receiving hole extending therethrough, each of said legs extending through one of said leg receiving holes and said second ends abutting said panels, said central area being convex and defining a convex portion, each of said panels having secondary holes extending therethrough and being positioned on either side of said convex portion, each of a plurality of fasteners extending through one of said secondary holes and into said second support.

7. The system according to claim 1, further including:

a first support and a second support being vertically spaced from each other, said first support comprising a frame including a plurality of elongated frame members, said second support comprising a ceiling;

a plurality of legs, each of said legs having a first end and a second end, each of said legs being selectively telescoping and each of said first and second ends has a hemispherical shape and includes an arcuate side and a planar side, said planar sides each facing away from an associated one of said legs to define a terminal end of said legs, each of said planar sides lying in a plane orientated approximately perpendicular to a longitudinal axis of said associated one of said legs;

a plurality of first brackets, each of said first brackets being pivotally coupled to one of said first ends, each of said first brackets being attached to said first support each of said first brackets includes:

a first plate having an upper edge;

a second plate having an upper edge;

a middle plate being attached to and extending between said upper edges of said first and second plates, said first and second plates being orientated parallel to each other, said middle plate having a centrally located aperture extending therethrough, each of said legs extending through one of said apertures and said first ends abutting said middle plate, each of said first and second plates having an opening extending therethrough and each of said openings is aligned with each other, said frame members being positioned between said first and second plates, said middle plate being angled upwardly from said upper edges to said aperture;

a plurality of fasteners, each of said fasteners extending through an aligned one of said openings and releasably securing said frame members between said first and second plates;

a plurality of second brackets, each of said second brackets being pivotally coupled to one of said second ends, each of said second brackets being attached to said second support.

8. The system according to claim 7, wherein each of said second brackets comprising a panel, each of said panels having a central area having a leg receiving hole extending therethrough, each of said legs extending through one of said leg receiving holes and said second ends abutting said panels.

9. The system according to claim 7, wherein said central area is convex and defines a convex portion, each of said panels having secondary holes extending therethrough and being positioned on either side of said convex portion, each of a plurality of fasteners extending through one of said secondary holes and into said second support.

* * * * *